US005646659A

United States Patent [19]

Moriyama et al.

[11] Patent Number: 5,646,659

[45] Date of Patent: Jul. 8, 1997

[54] INK JET RECORDING APPARATUS, AND METHOD WITH CONTROL OF INK DROPS AND INK MIST

[75] Inventors: Jiro Moriyama; Yutaka Koizumi, both of Yokohama; Hisashi Fukushima, Kawasaki; Toshiaki Hirosawa, Hiratsuka; Torachika Osada; Haruhiko Moriguchi, both of Yokohama; Hidemi Kubota, Komae; Masami Izumizaki, Yokohama, all of Japan

[73] Assignee: Canon Kabushiki Kaisha, Tokyo, Japan

[21] Appl. No.: 967,973

[22] Filed: Oct. 28, 1992

[30] Foreign Application Priority Data

Oct. 31, 1991 [JP] Japan ..... 3-286564

[51] Int. Cl.[6] ..... B41J 2/01; B41J 2/06

[52] U.S. Cl. ..... 347/55

[58] Field of Search ..... 346/1.1, 140 R; 347/55, 34, 44, 10, 76, 77; B41J 2/06

[56] References Cited

U.S. PATENT DOCUMENTS

| | | | |
|---|---|---|---|
| 4,024,548 | 5/1977 | Alonso et al. | 347/55 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,504,844 | 3/1985 | Ebi et al. | 346/140 R |
| 4,558,333 | 12/1985 | Sugitani et al. | 346/140 R |
| 4,608,577 | 8/1986 | Hori | 346/140 R |
| 4,723,129 | 2/1988 | Endo et al. | 346/1.1 |
| 4,740,796 | 4/1988 | Endo et al. | 346/1.1 |
| 4,752,783 | 6/1988 | Saito et al. | 346/1.1 |
| 5,298,926 | 3/1994 | Furushima et al. | 347/34 |

FOREIGN PATENT DOCUMENTS

| | | | |
|---|---|---|---|
| 36-013768 | 8/1961 | Japan . | |
| 54-056847 | 5/1979 | Japan . | |
| 55-86762 | 6/1980 | Japan . | |
| 59-123670 | 7/1984 | Japan . | |
| 59-138461 | 8/1984 | Japan . | |
| 60-046257 | 3/1985 | Japan . | |
| 60-071260 | 4/1985 | Japan . | |
| 62-151348 | 7/1987 | Japan . | |
| 62-225353 | 10/1987 | Japan . | |
| 4-166343 | 6/1992 | Japan | B41J 2/06 |

*Primary Examiner*—Alrick Bobb

*Attorney, Agent, or Firm*—Fitzpatrick, Cella, Harper & Scinto

[57] ABSTRACT

An ink jet recording apparatus of the present invention has an ink jet recording head having an orifice from which an ink drop is ejected and an energy generation means for ejecting an ink fluid in the orifice. A first electrode is formed in the orifice and is connected electrically to the ink fluid. A second electrode is formed in an opposite position to the orifice with a designated distance from the orifice. A voltage controller applies a first voltage during a time period from a time when an ink fluid is ejected from the orifice to a time when the ink fluid is separated in 2 or more ink drops during traveling, and immediately after applying the first voltage, applies a second voltage which has an identical polarity to a polarity of the first voltage and has an absolute value less than an absolute value of the first voltage.

35 Claims, 16 Drawing Sheets

INK JET RECORDING APPARATUS, AND METHOD WITH CONTROL OF INK DROPS AND INK MIST

BACKGROUND OF THE INVENTION

1. Field of the Invention

The present invention relates to an ink jet recording apparatus and more particularly to a recording apparatus for recording by whole or part of ink drops ejected from the recording head are controlled or collected by means of electrostatic power, and an ink drop control method and an ink mist adsorption method, both for use in the apparatus.

2. Description of Related Art

Conventionally, an ink jet recording apparatus is known as to record characters and images by ejecting ink fluids in the recording head toward the recording medium. In comparison with another recording apparatus, this apparatus has such advantages as enabling (1) high speed recording, (2) multiple-color recording, (3) recording on ordinary papers that has not been specially processed, and (4) noise-free recording operations.

Such an ink jet recording apparatus has at least a recording head having an orifice from which ink fluids are ejected. The recording head ejects ink drops from the orifice selectively in responsive to recording information supplied to the recording head itself in order to form characters and images onto the recording medium.

An ink jet recording apparatus using electrostatic force for ejecting ink fluids is disclosed in Japanese Patent Application Publication No. 13768/1961.

An ink jet recording apparatus which enables the increase of the recording quality by accelerating the ejected ink drop by electrostatic force developed by a designated electric field applied to the ink drop ejected by the electro-thermal conversion device is disclosed in Japanese Patent Application Laying-Open No. 46257/1985.

A structure for the recording method using the electro-thermal conversion device and electrostatic force is disclosed in Japanese Patent Application Laying-Open No. 151348/1987.

A method for ejecting ink fluids by electrostatic force developed by the electric field generated at the time when the ink fluids are heated up to the high temperature by the electro-thermal conversion device is shown in Japanese Patent Application Laying-Open No. 225353/1987.

Some recording methods involve using charging electrodes for transferring charges to the traveling ink drops and deflecting electrodes for deflecting charged ink drops.

In a prior art recording method not using electrostatic forces, a single ink drop ejected from the orifice of the recording head in a single ejection operation may be broken into several pieces of ink drops during its traveling. Among these broken pieces of ink drops, fine-sized ink drops located in the backward side of the ink drop mist tend not to travel in straight lines but to reach positions on the recording medium different from positions to which large-sized ink drops are projected, which leads to a reduction in the recording quality of recorded characters and images.

In a recording method where ink fluids are extracted for ejection by electrostatic forces and/or ejected ink fluids are forced by electrostatic forces, the electric field developed for ejecting the ink fluid or accelerating the ink drop between the orifice of the recording head and the recording medium may disturb the trajectory of traveling ink drops. Specifically, (1) the amount of ink fluids transported from the orifice of the recording head to the recording medium is less than that in the case where the electric field does not exist; or (2) for satellite drops, the backward part of the ejected ink drop goes back to the orifice of the recording head and blocks the ordinary ejection operation of ink fluids. More specifically, due to ink fluids piled up on and near the orifice, the trajectory of ejected ink drops may not be straight or, in the worst case, the ink fluids can not ejected at all.

FIG. 1 shows an outline of the prior-art ink jet recording apparatus using electro-static forces.

In FIG. 1, a recording head 1 has a plurality of nozzles 10 which are arrayed perpendicularly to a front surface of the recording head 1. In this case, the recording head 1 has four nozzles 10. Each of the nozzles 10 has an orifice 21 which is formed at the front thereof. A resistor 2 is disposed within the nozzle 10 and serves as an electro-thermal conversion device. Each of the resistors 2 is connected through a wiring 11 to a resistor driving circuit 3 for driving the resistor 2. A common fluid chamber 22 is disposed within the recording head 1 and is connected to all of the nozzles 10. The common fluid chamber 22 is connected to an ink supply tube 23 for introducing an ink 24 from a tank (not shown) into the common fluid chamber 22. A first electrode 6 is provided in the common fluid chamber 22. A second electrode 8 is disposed at a distance of d from the recording head 1 and is opposite to the front surface thereof as shown in FIG. 1. A recording medium 7 is placed on a surface of the second electrode 8. The first and second electrodes 6 and 8 are electrically connected to each other. By applying a voltage to the resistor 2, an ink drop 4 is ejected. A voltage V is applied between the first and second electrode 6 and 8, and the ejected ink drop 4 is accelerated to reach to a surface of the recording medium 7. The faster the ink drop travels, the higher the recording quality of recorded characters and images are.

FIG. 2 is the side view of what is shown in FIG. 1. FIG. 3 is a diagrammatic view of the ink drop ejection state of a specific nozzle in case that the voltage V is 0. What is shown in FIG. 3 is the trajectory of the ink drop at the time between 10 and 100 μsec after the signal for requesting the ejection of the ink drop is received by the recording head. The distance, d, between the top of the orifice, x=0, and the surface of the recording medium is 0.5 mm. At t=50 μsec, the ejected ink drop is completely separated into the main drop at the forward part and the satellite drop in the backward part, and both separated drops reach the recording medium.

However, due to the air flow generated by the relative movement of the recording head in the recording operation to the recording medium 7, the satellite drop may be projected onto unexpected positions in a definite probability or may go back to the top face of the nozzle of the recording head 1.

In contrast to FIG. 3, what is shown in FIG. 4 is the case where the voltage V is+1000 V in order to form an electric field E with its intensity being 2000 V/mm(=1000 V/0.5 mm). In case shown by FIG. 4, the ink drop is separated at the time t=50 μsec. After 50 μsec, the main drop is accelerated until reaching the recording medium. The speed of the satellite drop is reduced and finally moved backward to the orifice 21 until reaching to the orifice 21 of the recording head 1. As a result, the phenomena (1) and (2) described above arise. These phenomena are considered to be caused by the mechanism such that an extended ink fluid to be separated in drops is polarized dielectrically, and immediately after that, two distinctive parts, the major drop and the satellite drop, are developed, where the major drop is charged with the opposite polarity to that of the surface of the recording medium and the satellite drop is charged with the identical polarity to that of the surface of the recording medium.

SUMMARY OF THE INVENTION

An object of the present invention is to provide an ink jet recording apparatus, and an ink drop control method and an ink mist adsorption method in this apparatus, all of which enable a high-quality recording as well as a reliable recording continuously so as to solve the above mentioned technical problems.

Another object of the present invention is to provide an ink jet recording apparatus, and an ink drop control method and an ink mist adsorption method in this apparatus, all of which enable a high-quality recording as well as a reliable recording continuously which can be achieved by accelerating main drops and by preventing a satellite drop from return to an orifice of a recording head of the ink jet recording apparatus or by intentionally accelerating the satellite drop.

A further object of the present invention is to provide an ink jet recording apparatus, and an ink drop control method and an ink mist adsorption method in this apparatus, all of which enable high-quality recording and which prevent fine ink drops from reaching a position on a recording medium which is not predetermined.

Yet another object of the present invention is to provide an ink jet recording apparatus of the present invention, an ink drop control method and an ink mist adsorption method in this apparatus, the apparatus having an ink jet recording head having an orifice from which an ink drop is ejected and an energy generation means for ejecting an ink fluid in the orifice, a first electrode formed in the orifice, the electrode connected electrically to the ink fluid, a second electrode formed in an opposite position to the orifice with a designated distance from the orifice, and a voltage control means which applies a first voltage during a time period from a time when an ink fluid is ejected from the orifice to a time when the ink fluid is separated in 2 or more ink drops during its traveling, and immediately after applying the first voltage, applies a second voltage which has an identical polarity to a polarity of the first voltage and has an absolute value less than an absolute value of the first voltage.

In the first aspect of the present invention, an ink jet recording apparatus comprises: an ink jet recording head having an orifice from which an ink drop is ejected and an energy generation means for ejecting an ink fluid in the orifice; a first electrode formed in the orifice, the electrode connected electrically to the ink fluid; a second electrode formed in an opposite position to the orifice at a designated distance from the orifice; and a voltage control means which applies a first voltage during a time period from a time when an ink fluid is ejected from the orifice to a time when the ink fluid is separated in 2 or more ink drops during traveling, and immediately after applying the first voltage, applies a second voltage which has an identical polarity to a polarity of the first voltage and has an absolute value less than an absolute value of the first voltage.

In the second aspect of the present invention, an ink jet recording apparatus comprises: an ink jet recording head having an orifice from which an ink drop is ejected and an energy generation means for ejecting an ink fluid in the orifice; a first electrode formed in the orifice, the electrode connected electrically to the ink fluid with a lower resistor contact; a second electrode formed in an opposite position to the orifice at a designated distance from the orifice; and a voltage control means which applies a first voltage during a time period from a time when an ink fluid is ejected from the orifice to a time when the ink fluid is separated in 2 or more ink drops during traveling, and immediately after applying the first voltage, applies a third voltage which has an opposite polarity to a polarity of the first voltage.

In the third aspect of the present invention, an ink jet recording apparatus comprises: an ink jet recording head having an orifice from which an ink drop is ejected and an energy generation means for ejecting an ink fluid in the orifice; a first electrode formed in the orifice, the electrode connected electrically to the ink fluid; a second electrode formed in an opposite position to the orifice at a designated distance from the orifice; a third electrode formed between the orifice and the second electrode; and a mechanism for separating an ink drop ejected from the orifice into a plurality of drops during an ink fluid ejection operation or an ink drop acceleration operation with respect to a single ink drop ejection operation by the ink jet recording head and for collecting a backward part of the plurality of separated ink drops.

In the fourth aspect of the present invention, an ink drop control method in an ink jet recording apparatus, the apparatus comprises: an ink jet recording head having an orifice from which an ink drop is ejected and an energy generation means for ejecting an ink fluid in the orifice; a first electrode formed in the orifice, the electrode connected electrically to the ink fluid; a second electrode formed in an opposite position to the orifice at a designated distance from the orifice; and a voltage control means for controlling a voltage between the first electrode and the second electrode, wherein the voltage control means applies a first voltage during a time period from a time when an ink fluid is ejected from the orifice to a time when the ink fluid is separated in 2 or more ink drops during traveling; and immediately after applying the first voltage, applies a second voltage which has an identical polarity to a polarity of the first voltage and has an absolute value less than an absolute value of the first voltage.

In the fifth aspect of the present invention, an ink drop control method in an ink jet recording apparatus, the apparatus comprises: an ink jet recording head having an orifice from which an ink drop is ejected and an energy generation means for ejecting an ink fluid in the orifice; a first electrode formed in the orifice, the electrode connected electrically to the ink fluid with a lower resistor contact; a second electrode formed in an opposite position to the orifice at a designated distance from the orifice; and a voltage control means for controlling a voltage between the first electrode and the second electrode,wherein the voltage control means applies a first voltage during a time period from a time when an ink fluid is ejected from the orifice to a time when the ink fluid is separated in 2 or more ink drops during traveling; and immediately after applying the first voltage, applies a third voltage which has an opposite polarity to a polarity of the first voltage.

In the sixth aspect of the present invention, an ink mist adsorption method in an ink jet recording apparatus, the apparatus comprises: an ink jet recording head having an orifice from which an ink drop is ejected and an energy generation means for ejecting an ink fluid in the orifice; a first electrode formed in the orifice, the electrode connected electrically to the ink fluid; a second electrode formed in an opposite position to the orifice at a designated distance from the orifice; and a third electrode formed between the orifice and the second electrode, wherein an ink drop ejected from the orifice is separated into a plurality of drops during an ink fluid ejection operation or an ink drop acceleration operation with respect to a single ink drop ejection operation by the ink jet recording head and for collecting a backward part of the plurality of separated ink drops.

In the first, the second, the fourth, and the fifth aspects of the present invention; an intensity of an electric field developed by the first voltage may be 800 V/mm or more. A voltage applied between the first electrode and the second electrode may be shaped in a pulse. A voltage applied between the first electrode and the second electrode may be shaped in a sinusoidal wave. An electric field developed by a voltage applied between the first electrode and the second electrode may be formed by a mechanical part. The energy generation means may be formed by an electro-thermal conversion device.

Also, in the third and the sixth aspects of the present invention; an effective intensity of an electric field developed between and by the first electrode and the second electrode may be 800 V/mm or more. A polarity of a voltage applied from the first electrode to the second electrode may be opposite to a polarity of a voltage applied from the first electrode to the third electrode. A material used for the third electrode may be a porous and electrically conductive material. An electric field developed by a voltage applied between the first electrode and the second electrode may be formed by a mechanical part. The energy generation means may be formed by an electro-thermal conversion device.

Furthermore, in the first to the sixth aspects of the present invention; the energy generation means may be formed by an electro-mechanical conversion device. The ink jet recording head may accommodate an ink which is ejected from the orifice.

The above and other objects, effects, features and advantages of the present invention will become more apparent from the following description of embodiments thereof taken in conjunction with the accompanying drawings.

DETAILED DESCRIPTION OF THE PREFERRED EMBODIMENTS

In the following, by referring to accompanying drawings, embodiments of the present invention are more fully described in the detailed description.

The first Embodiment

Figure 5:
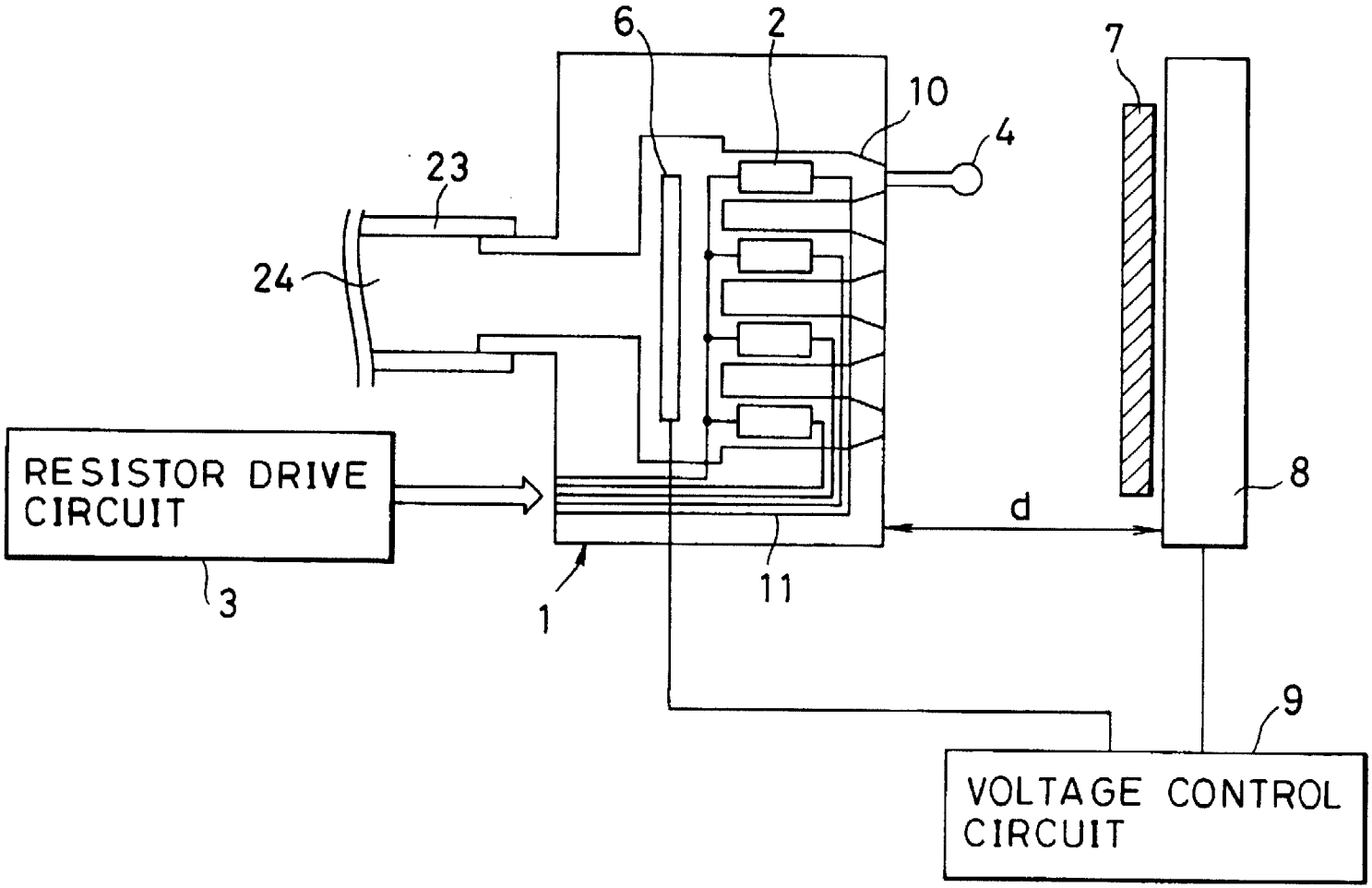
FIG. 5 is a diagrammatical view for designating a control method of electric-field applied to liquid drops in a first embodiment of an ink jet recording apparatus of the present invention.

FIG. 5 is a structural view for realizing a control method of electric-field applied to liquid. drops used for recording in a first embodiment of the recording apparatus of the present invention. An ink drop 4 is ejected from the nozzle 10 by the thermal energy generated in the resistor 2 used as an electro-thermal conversion device of the head body 1 which is driven by the resistor drive circuit 3 connected through the wirings 11 with the voltage Vh. FIG. 5 represents the moment when an ink drop begins to be ejected from the top nozzle. An electric field E is applied to the ejected ink drop in the space between the first electrode 6 contacting electrically the ink fluid 5 in the head and the second electrode 8 formed behind the recording medium 7, the distance between which is d. A component 9 is a voltage control circuit for generating the electric field. Ink fluids are supplied through the ink supply tube for establishing continuous supplying ink drops to be developed onto the recording medium.

Figure 6A:
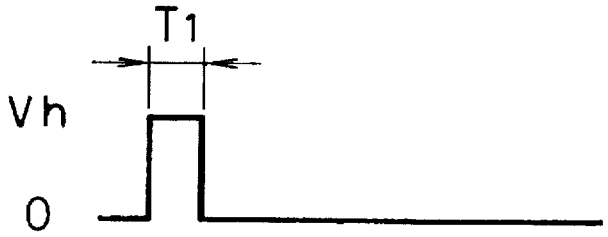
FIG. 6A is a diagram illustrating voltage signals given by resistor drive circuit in the first embodiment of the ink jet recording apparatus of the present invention.
Figure 6B:
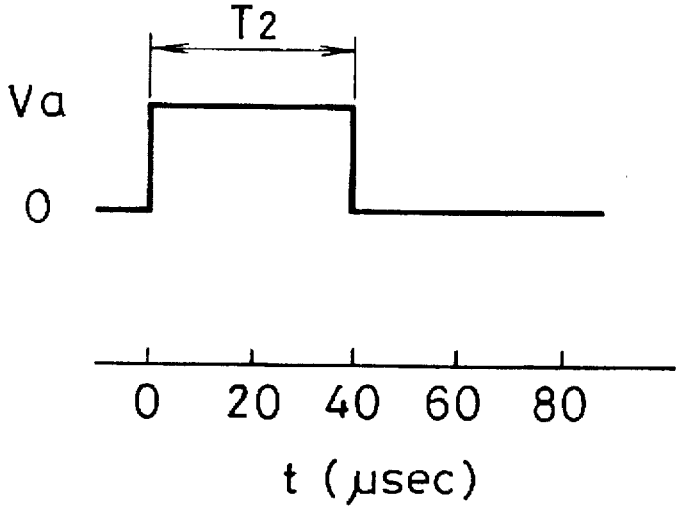
FIG. 6B is a diagram illustrating voltage signals given by voltage control circuit in the first embodiment of the ink jet recording apparatus of the present invention.

FIG. 6A illustrates a diagram of voltage signals given to the resistor 2 and FIG. 6B illustrates a diagram of voltage signals supplied by the voltage control circuit, respectively.

The resistor 2 used as an electro-thermal conversion device is 400Ω, and the voltage Vh by about 30 V is applied during the time period T1, 10 μsec. An ink drop starts to be ejected due to the electric field developed by this applied voltage. At the same time, another voltage Va by 1000 V is applied between the first electrode 6 and the second electrode 8. The duration time, T2, of the voltage Va is 40 μsec. The distance, d, between these electrodes 6 and 8 is 0.5 mm, and the intensity of the electric field E established at the gap between the top part of the nozzle 10 and the second electrode 8 is 2000 V/mm. The electric field E with its intensity being greater than 800 V/mm is effectively used for establishing good-conditioned ejection of ink drops.

Figure 1:
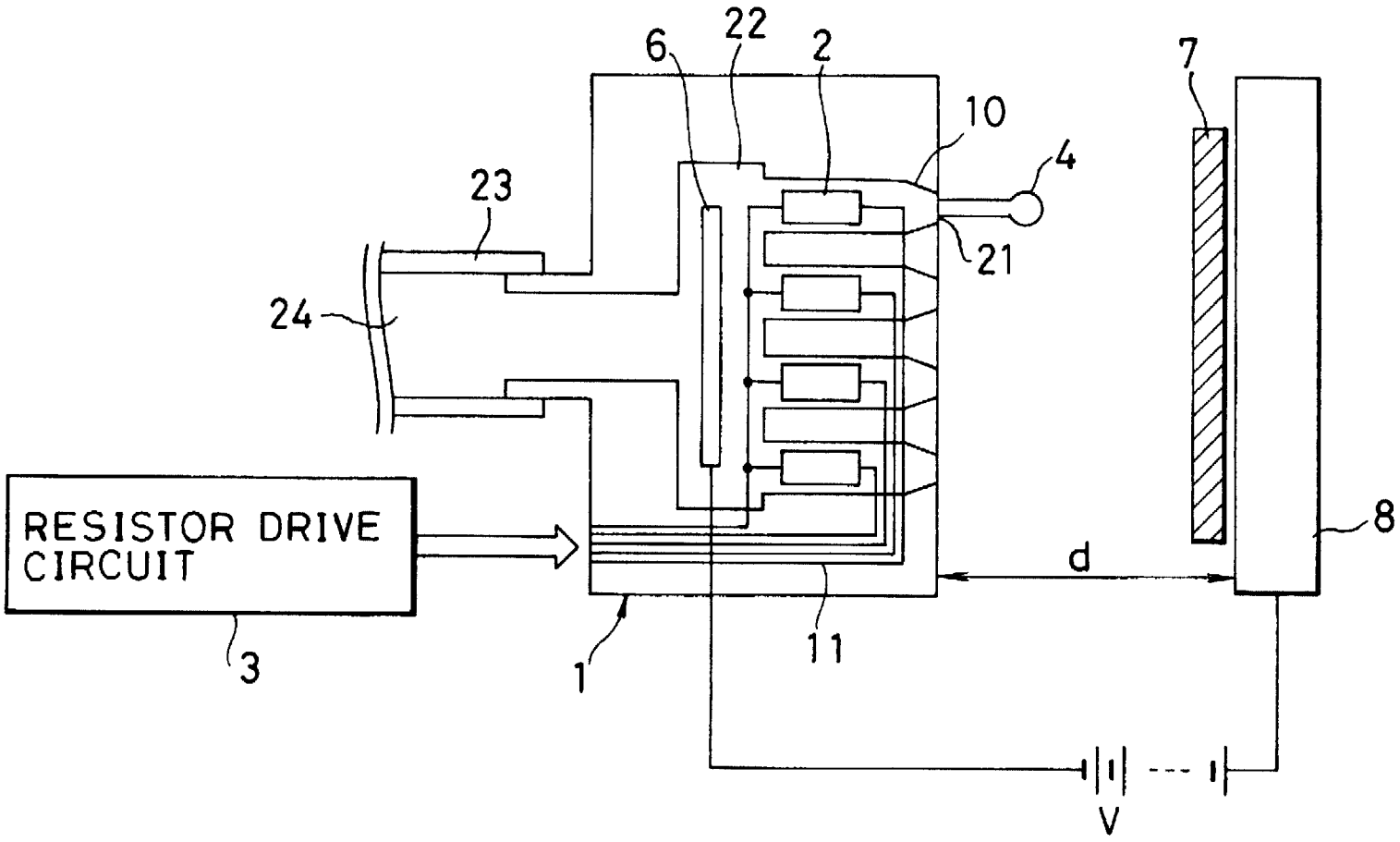
FIG. 1 (PRIOR ART)
FIG. 1 is a cross-sectional view showing an outline of a prior-art ink jet recording apparatus using electro-static forces.
Figure 2:
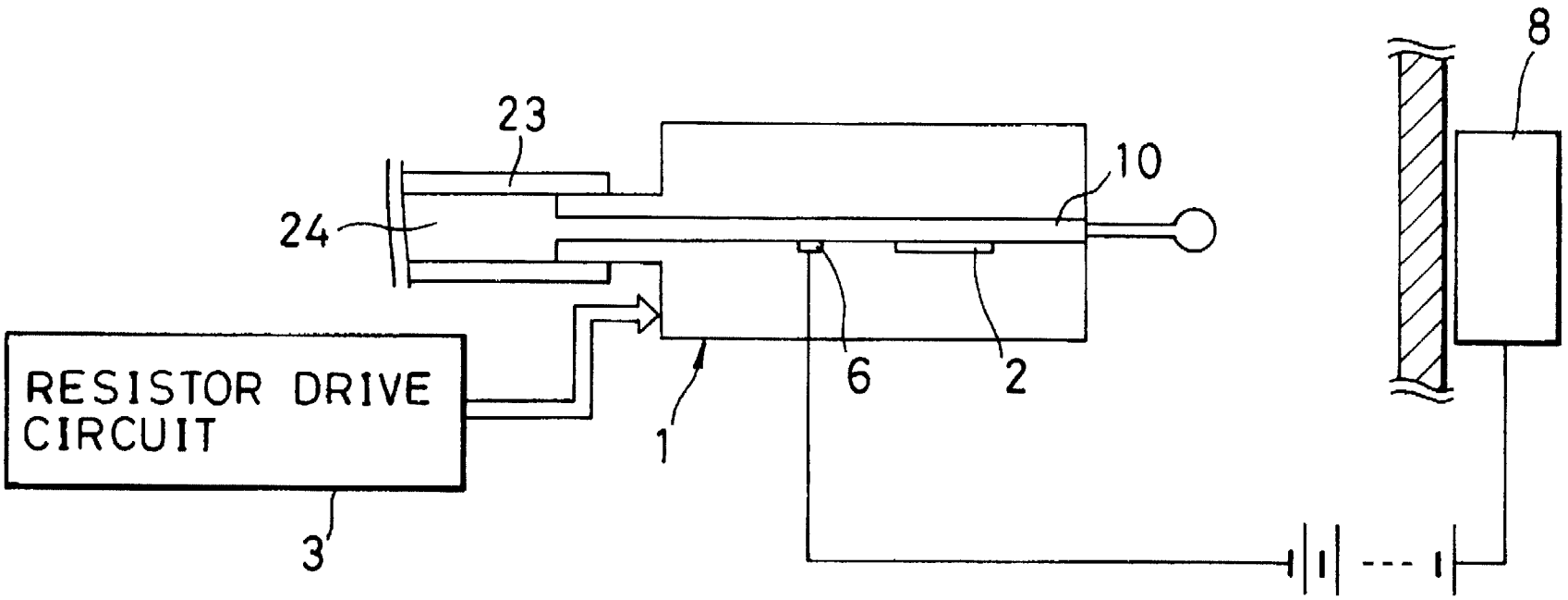
FIG. 2 (PRIOR ART)
FIG. 2 is a side view showing an outline of the prior-art ink jet recording apparatus using electro-static forces.
Figure 3:
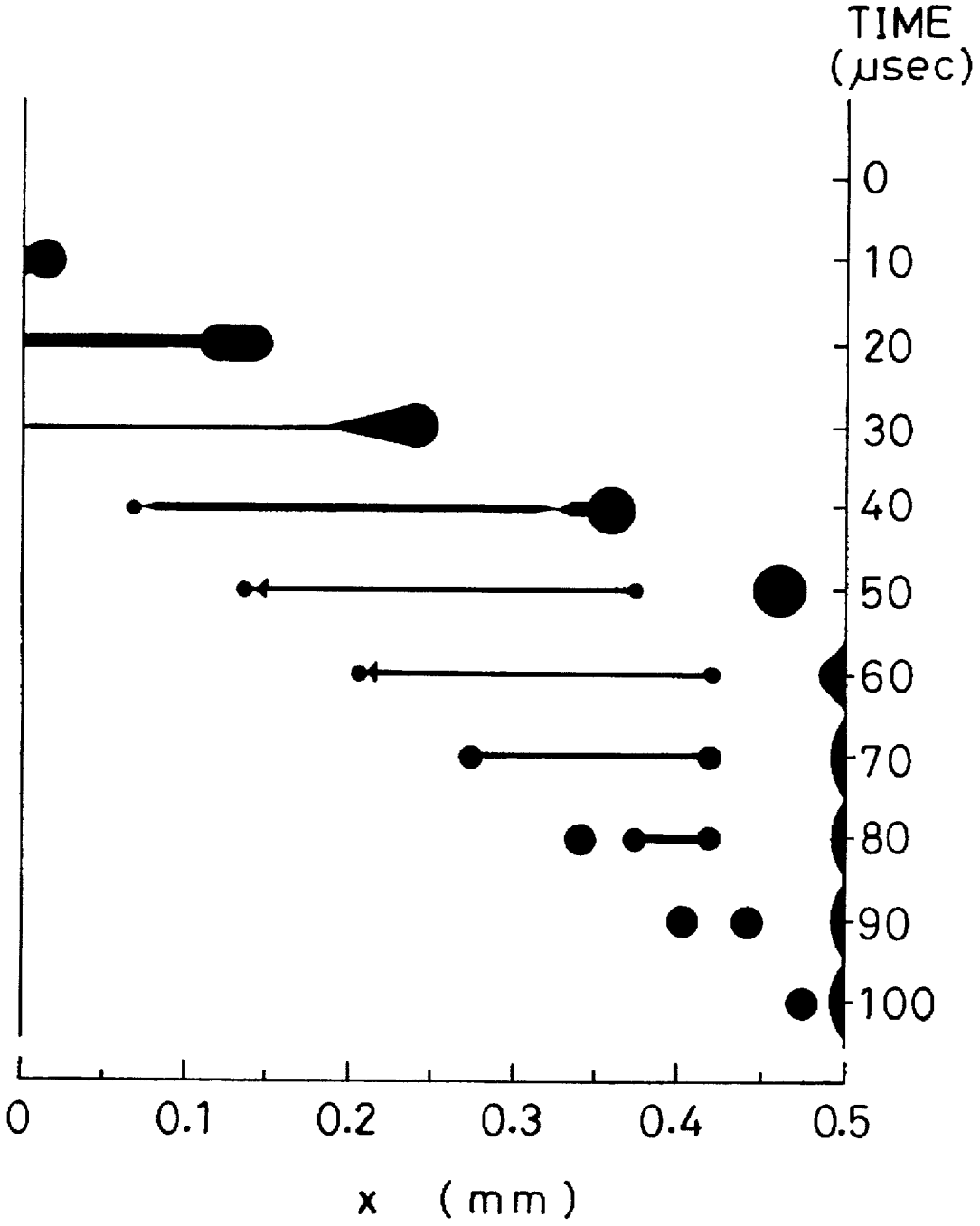
FIG. 3 (PRIOR ART)
FIG. 3 is a diagram illustrating an ink drop ejection status without electric fields in the prior-art ink jet recording apparatus.
Figure 4:
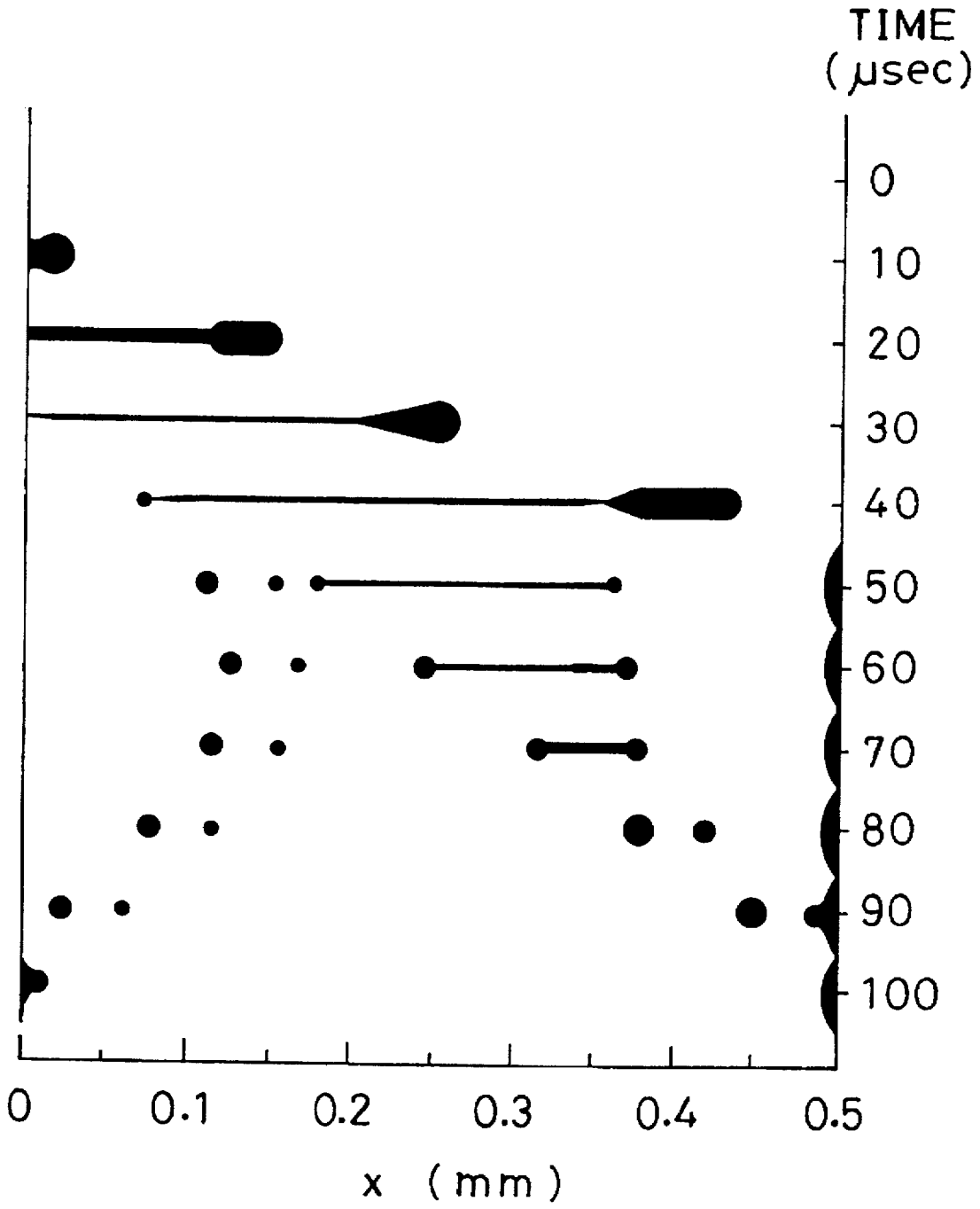
FIG. 4 (PRIOR ART)
FIG. 4 is a diagram illustrating an ink drop ejection status in the presence of fixed electric fields in the prior-art ink jet recording apparatus.
Figure 7:
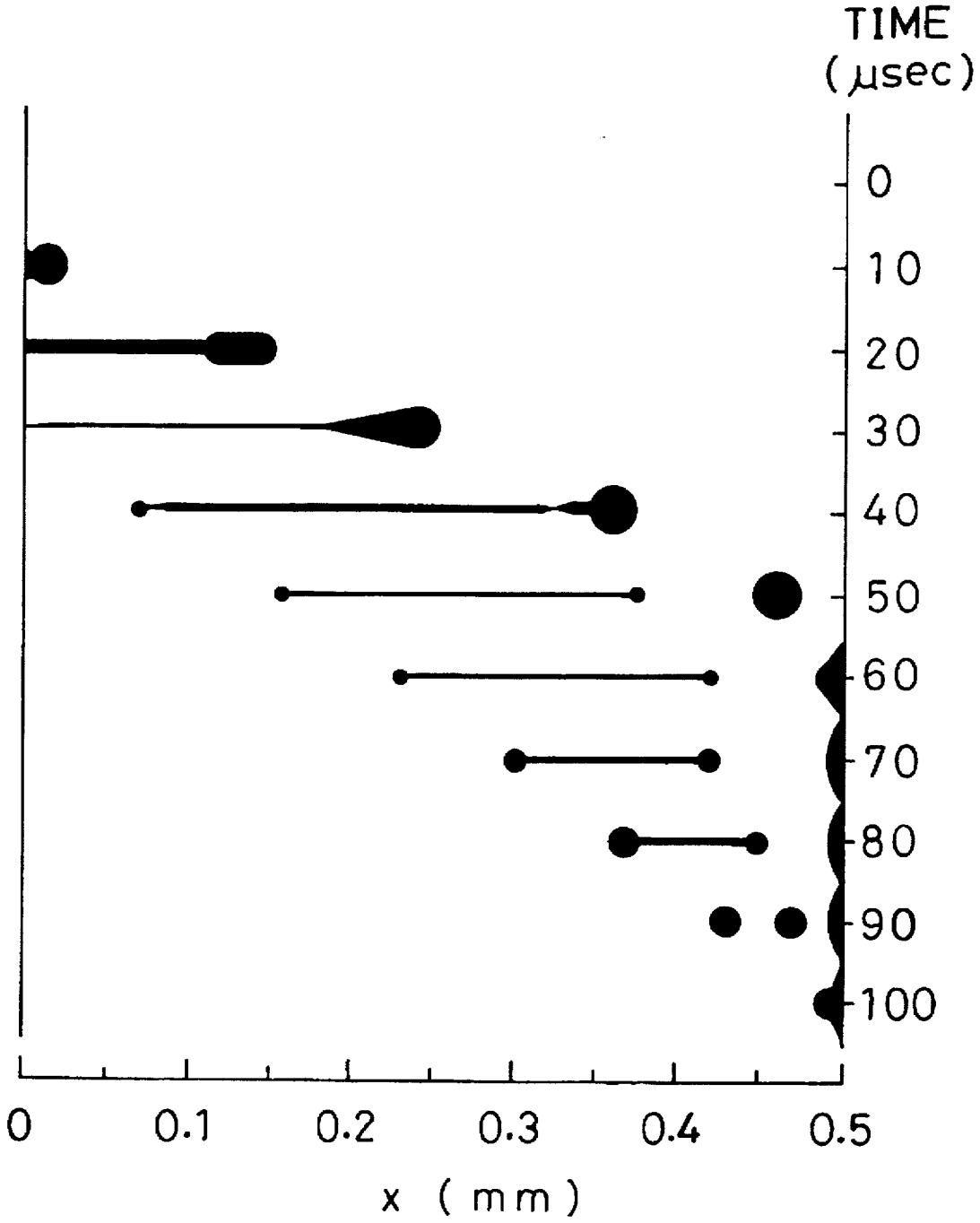
FIG. 7 is a diagram illustrating trajectories of an ink drop in the first embodiment of the ink jet recording apparatus of the present invention.

In case of controlling the electric fields in the above described manner, the trajectory of ink drops as shown in FIG. 7 is obtained. In FIG. 7, the major ink drop runs faster than those in the case shown in FIG. 3 where the electric fields are not developed. In addition, satellite drops are not brought back to the nozzle.

The higher the speed of the ejected ink drops, the higher the quality of recorded characters and images. So far, ink drops formed as shown in FIG. 7 make it possible to increase the recording quality.

The Second Embodiment

Figure 8A:
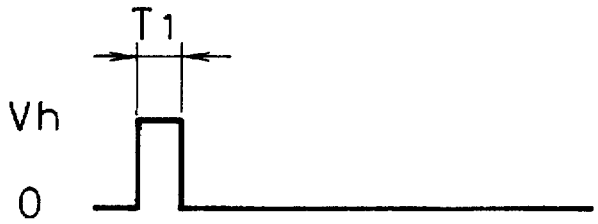
FIG. 8A is a diagram illustrating voltage signals given by a resistor drive circuit in a second embodiment of the ink jet recording apparatus of the present invention.
Figure 8B:
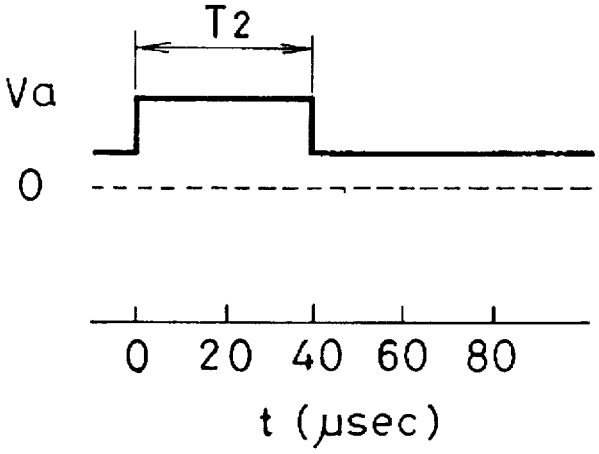
FIG. 8B is a diagram illustrating voltage signals given by a voltage control circuit in the second embodiment of the ink jet recording apparatus of the present invention.

In case that the intensity of the electric field E is 700 V/mm or less, the satellite ink drops are not brought back to the nozzle except the time T2 measured in μsec after the ink drop is ejected. In the first embodiment, the intensity of the electric. field E is 0 V except the time T2, 40 μsec after ejecting the ink drop. In contrast, in the second embodiment, as illustrated in FIGS. 8A and 8B, the intensity of the electric field during this period of time T2 is made to be 700 V/mm by selecting the voltage Va to be 350 V. In this case, the intensity of the electric field, E, is 2000 V/mm until the elapsed time reaches T2, 40 μsec.

Even by making the output signal from the voltage control circuit 9 as illustrated in FIGS. 8A and 8B, the effect similar to that in the first embodiment can be obtained.

The Third Embodiment

Figure 9A:
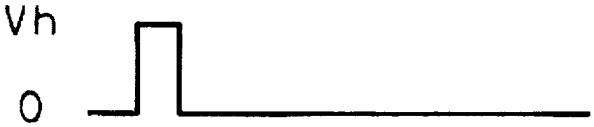
FIG. 9A is a diagram illustrating voltage signals given by a resistor drive circuit in a third embodiment of the ink jet recording apparatus of the present invention.
Figure 9B:
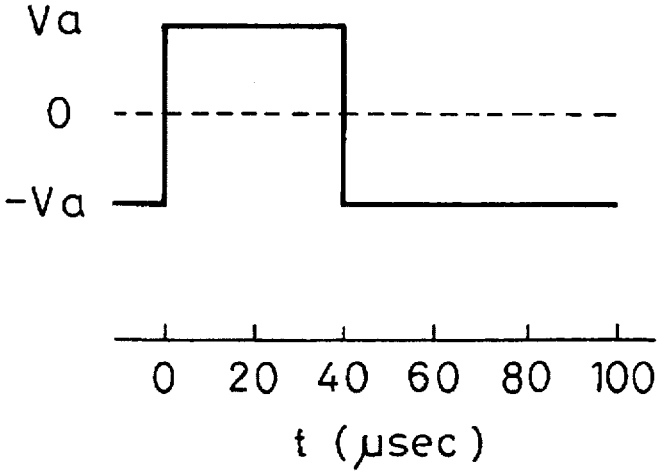
FIG. 9B is a diagram illustrating voltage signals given by voltage control circuit in the third embodiment of the ink jet recording apparatus of the present invention.

In this embodiment, as illustrated in FIGS. 9A and 9B, the output signal from the voltage regulating circuit, Va, is made to be negative, that is, −1000 V, at the time except T2, 40 μsec. In this case, the effect of the embodiment is found in the increase in the speed of the satellite ink drops.

The Fourth Embodiment

Figure 10A:
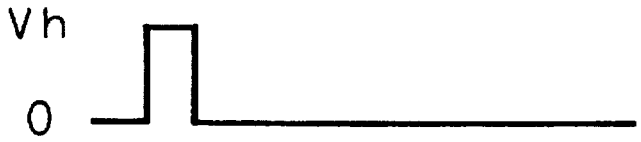
FIG. 10A is a diagram illustrating voltage signals given by resistor drive circuit in a fourth embodiment of the ink jet recording apparatus of the present invention.
Figure 10B:
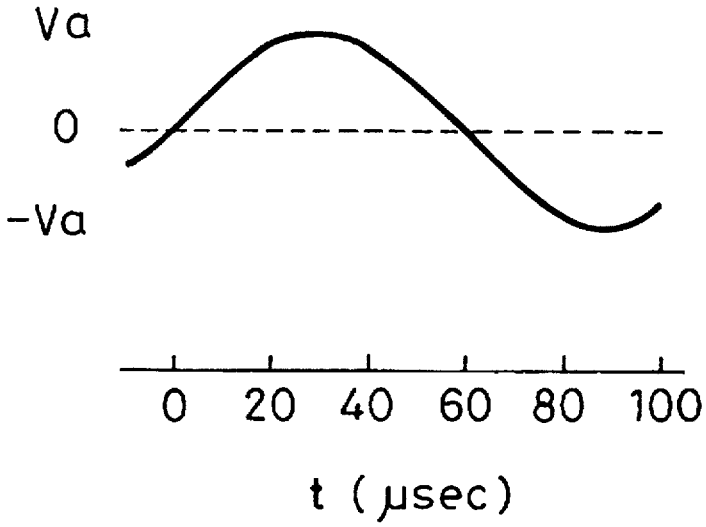
FIG. 10B is a diagram illustrating voltage signals given by voltage control circuit in the fourth embodiment of the ink jet recording apparatus of the present invention.

In this embodiment, as illustrated in FIGS. 10A and 10B, the output signal from the voltage control. circuit 9 is made to be a sinusoidal wave. In this; case, there is an advantage for simplifying the circuit structure of the voltage control circuit 9.

The Fifth Embodiment

Figure 11:
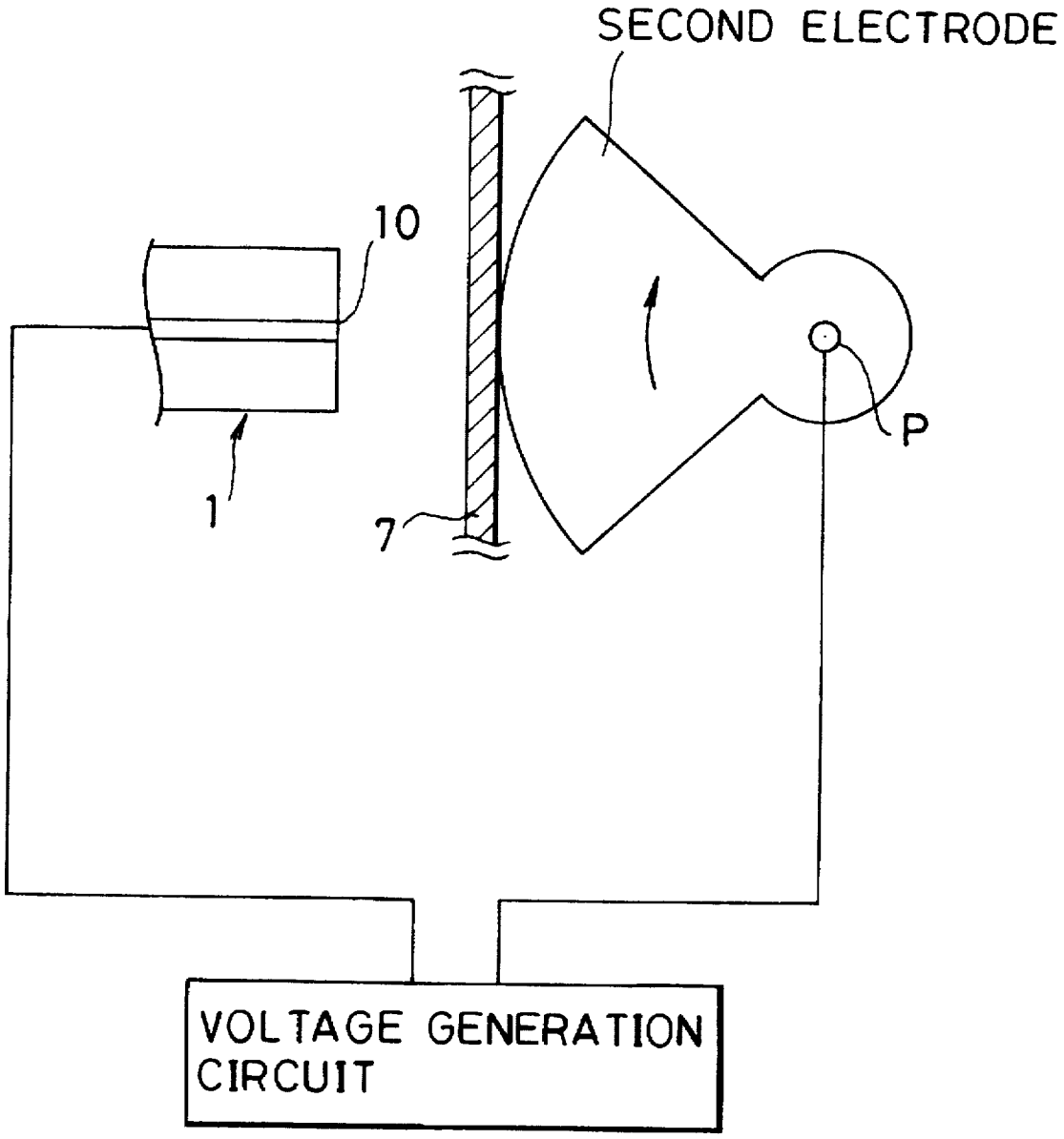
FIG. 11 is a diagrammatical view for designating a control method of electric-field applied to liquid drops in a fifth embodiment of the ink jet recording apparatus of the present invention.

The structure shown in FIG. 11 can bring the similar effect to that in the first embodiment for controlling the electric field. FIG. 11 is a side view of the head body 1. In FIG. 11, the shape of the second electrode is partly fan-shaped The second electrode rotates in the direction designated by the arrow around the rotating shaft P. This rotational movement is synchronized with the timing of ejecting ink drops. In case shown in FIG. 11, the electric field with high intensity is applied, and on the other hand, in case that the second electrode is moved far behind the recording medium 7, the intensity of the electric field is reduced.

In this embodiment, the voltage control circuit 9 supplies a voltage with its value being maintained constant.

The Sixth Embodiment

Figure 12:
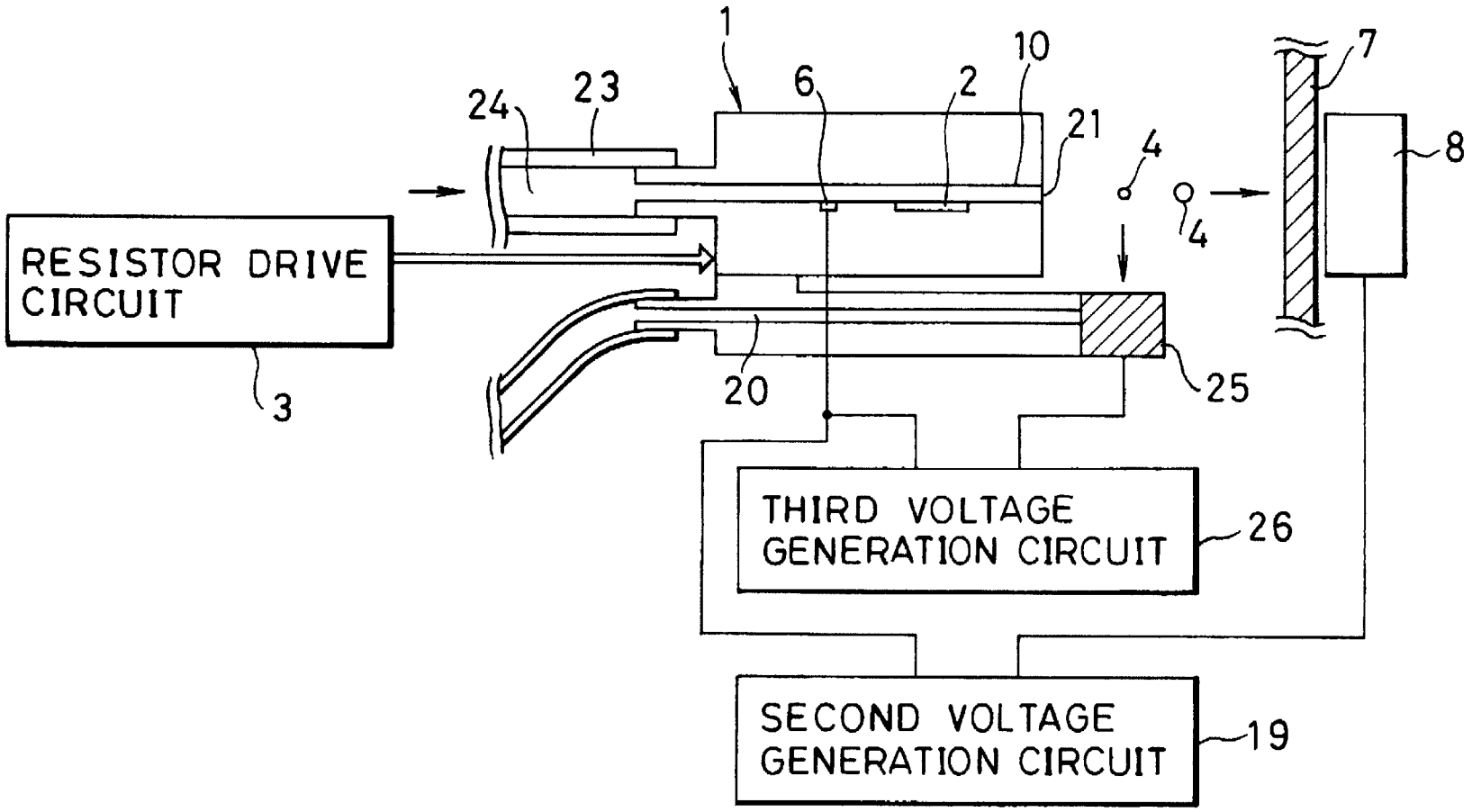
FIG. 12 is a diagrammatical view of a sixth embodiment of the ink jet recording apparatus of the present invention.

FIG. 12 shows the sixth embodiment of the present invention. In FIG. 12, nozzles 10 are arranged in the direction vertical to the surface of the recording medium.

The recording head 1 has a plurality of nozzles 10, each of which has a resistor 2 used as an electro-thermal conversion device. By applying the voltage Vh to the resistor 2, ink drops 4 are ejected. In the electric field established between the first electrode 6 placed in the common fluid chamber 22 and the second electrode 8 placed behind the recording medium 7, between which the voltage V is applied, the top part of ink drops 4 is accelerated until reaching the surface of the recording medium 7. The recording medium 7 moves relatively to the recording head 1. The maximum frequency for ejecting cyclically ink drops is 2500 Hz.

A third electrode 25 is formed in the opposite side of the second electrode 8 with respect to the recording medium 7, that is, near the recording head 1. The voltage biased by+Va from the voltage of the first electrode 6 is applied to the second electrode 8 by the second voltage generation circuit 19, and the voltage biased by−Vb from the voltage of the first electrode 6 is applied to the third electrode 25 by the third voltage generation circuit 26.

Figure 13A:
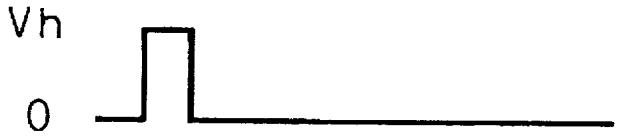
FIG. 13A is a diagram illustrating a voltage of Vh applied to a resistor in the sixth embodiment of the ink jet recording apparatus of the present invention.
Figure 13B:
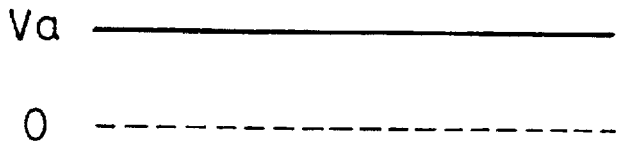
FIG. 13B is a diagram illustrating a voltage of +Va applied to a second electrode in the sixth embodiment of the ink jet recording apparatus of the present invention.
Figure 13C:
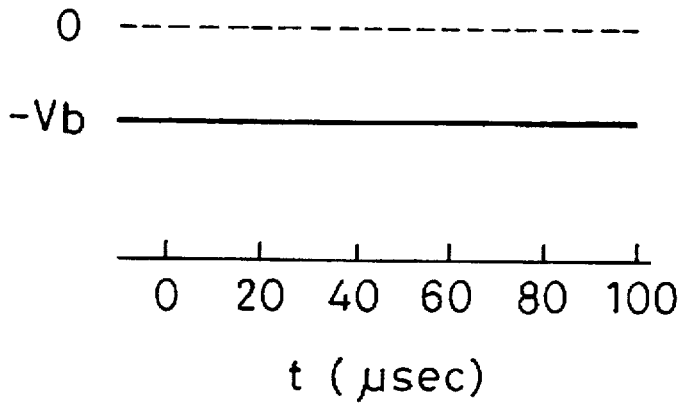
FIG. 13C is a diagram illustrating a voltage of −Vb applied to a second electrode in the sixth embodiment of the ink jet recording apparatus of the present invention.

FIG. 13A illustrates the voltage Vh applied to the resistor 2; FIG. 13B illustrates the voltage+Va applied to the second electrode 8; and FIG. 13C illustrates the voltage−Vb applied to the third electrode 25, respectively.

The voltage Vh applied to the resistor 2 is specified by the ink ejection signal not shown corresponding to the individual nozzle of the recording head 1 through the resistor driving circuit 3. The duration time of the voltage Vh is 10 μsec.

The voltage+Va applied to the second electrode 8 is+1000 V, and the voltage−Vb applied to the third electrode 25 is−400 V. The intensity of the electric field E developed between the first and second electrodes is 800 V/mm or more and is proved to be effective.

The ink drop 4 begins to be ejected immediately after the voltage Vh is applied, and in 50 μsec, the main drop and the satellite drop are separated in the forward and backward parts. Until then, due to the electric field developed between the first electrode 6 and the second electrode 8 between which the voltage+Va is applied, the main drop is charged in the negative charge and the satellite drop is charged in the positive charge. After that, in about 60 μsec, the main drop charged in the negative charge is accelerated and finally reaches the surface of the recording medium. The satellite drop charged in the positive charge is attracted toward the third electrode 25 which is biased by the negative voltage. That is, the satellite drops are collected onto the third electrode 25. The ink mist composed of satellite drops and collected on the third electrode 25 is further transported in an ink recovery route 20.

The third electrode is used as an electrode for recovering ink mist, which is composed of electrically conductive and porous materials.

A fine air flow occurs in the space where the ink drops travels, accompanied by the relative movement of the recording head and the recording medium. It is proved to be effective that the third electrode is formed at the downstream side of this fine air flow.

The Seventh Embodiment

Figure 14A:
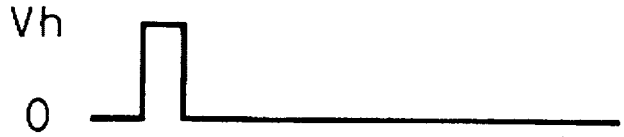
FIG. 14A is a diagram illustrating a voltage of Vh applied to a resistor in a seventh embodiment of the ink jet recording apparatus of the present invention.
Figure 14B:
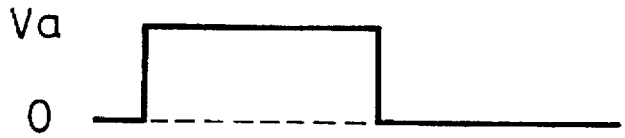
FIG. 14B is a diagram illustrating a voltage of +Va applied to a second electrode in the seventh embodiment of the ink jet recording apparatus of the present invention.
Figure 14C:
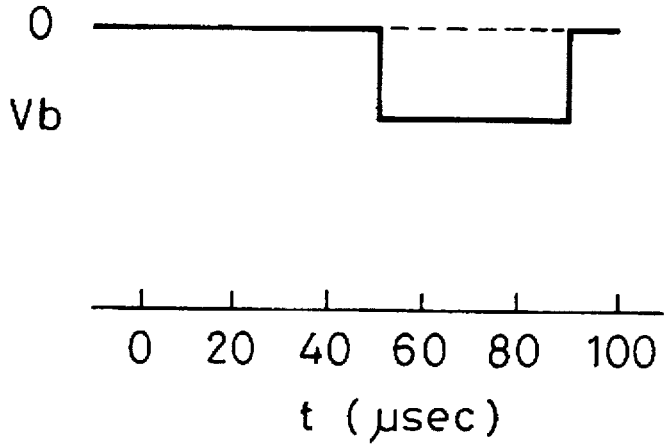
FIG. 14C is a diagram illustrating a voltage of −Vb applied to a third electrode in the seventh embodiment of the ink jet recording apparatus of the present invention.

FIGS. 14A, 14B and 14C illustrate the seventh embodiment of the present invention. FIG. 14A illustrates the voltage applied to the resistor; FIG. 14B illustrates the voltage applied to the second electrode; and FIG. 14C illustrates the voltage applied to third electrode. The voltage applied to the second electrode 8 with its value being+Va in relative to the first electrode 6 is turned on in about 50 μsec after the voltage Vh is applied to the resistor 2. Immediately after that, the voltage−Vb is applied to the third electrode 25. This way of control is the most effective in order to charge the forward and backward parts of the ink drop with distinctive polarities and to collect only the backward part of the ink drop onto the third electrode 25.

The Eighth Embodiment

Figure 15A:
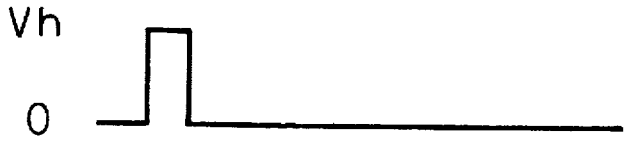
FIG. 15A is a diagram illustrating a voltage of Vh applied to a resistor in an eighth embodiment of the ink jet recording apparatus of the present invention.
Figure 15B:
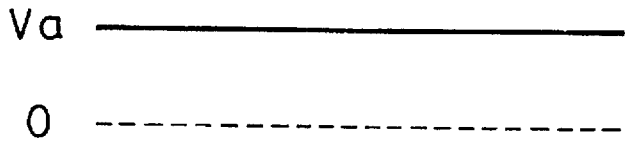
FIG. 15B is a diagram illustrating a voltage of +Va applied to a second electrode in the eighth embodiment of the ink jet recording apparatus of the present invention.
Figure 15C:
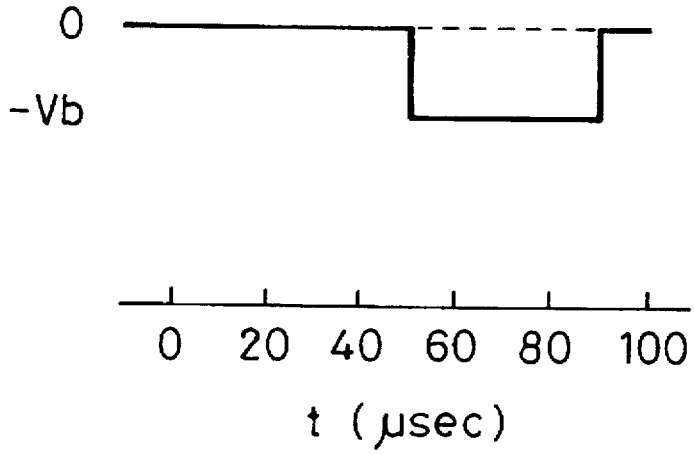
FIG. 15C is a diagram illustrating a voltage of −Vb applied to a third electrode in the eighth embodiment of the ink jet recording apparatus of the present invention.

FIGS. 15A, 15B and 15C illustrate the eighth embodiment of the present invention. FIG. 15A illustrates the voltage applied to the resistor; FIG. 15B illustrates the voltage applied to the second electrode; and FIG. 15C illustrates the voltage applied to the third electrode. The voltage applied to the second electrode 8 with its value being+Va in relative to the first electrode 6 is always constant so as to be+Va. When about 50 μsec has passed after the voltage Vh is applied to the resistor 2, the voltage−Vb is applied to the third electrode 25 for about 40 μsec.

The Ninth Embodiment

Figure 16:
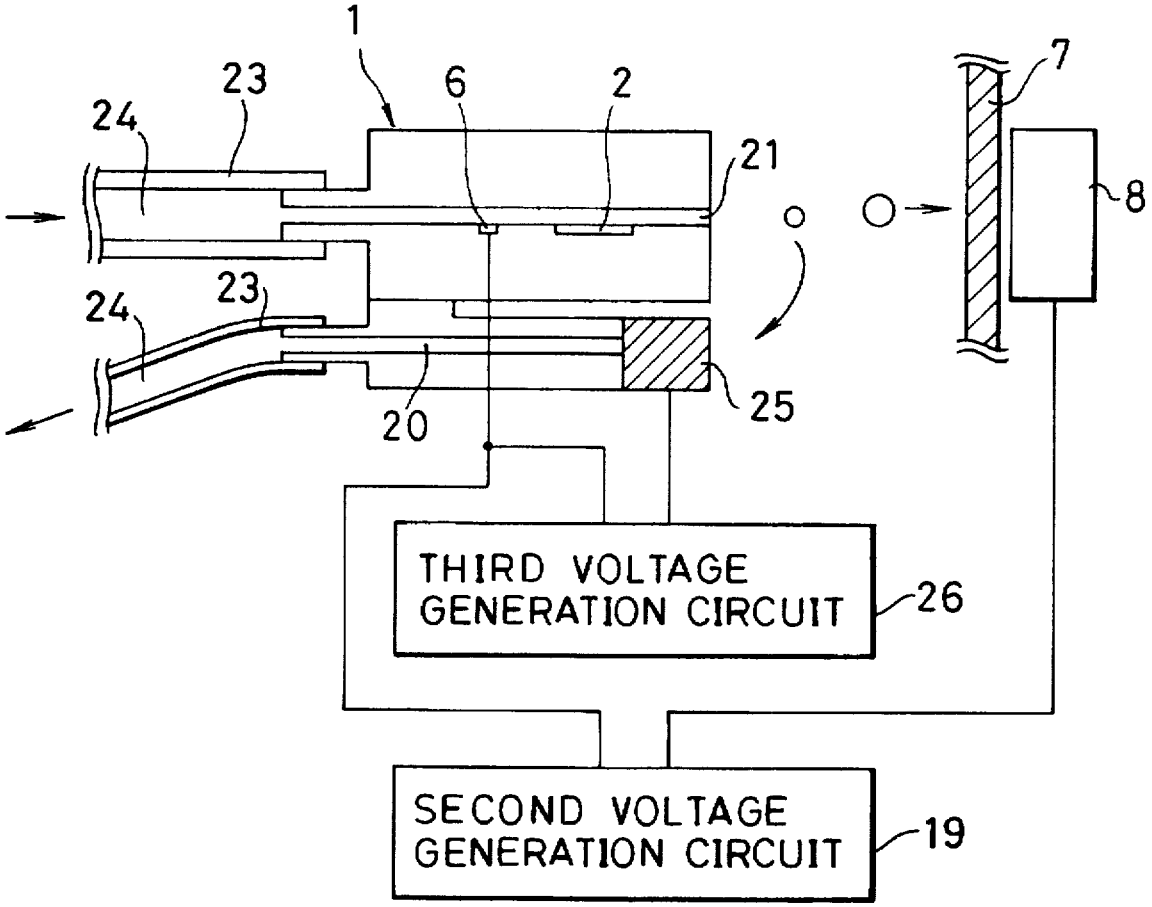
FIG. 16 is a diagrammatical view showing electrodes for collecting ink mist in a ninth embodiment of the ink jet recording apparatus of the present invention.

FIG. 16 shows the ninth embodiment of the present invention, where the third electrode is located near a front surface of the recording head 1 having orifices 21. In this embodiment, the gap between the recording head 1 and the recording medium 7, both of which move relative to each other, is extended, and an effect similar to that in the sixth embodiment can be obtained.

The Tenth Embodiment

Figure 17:
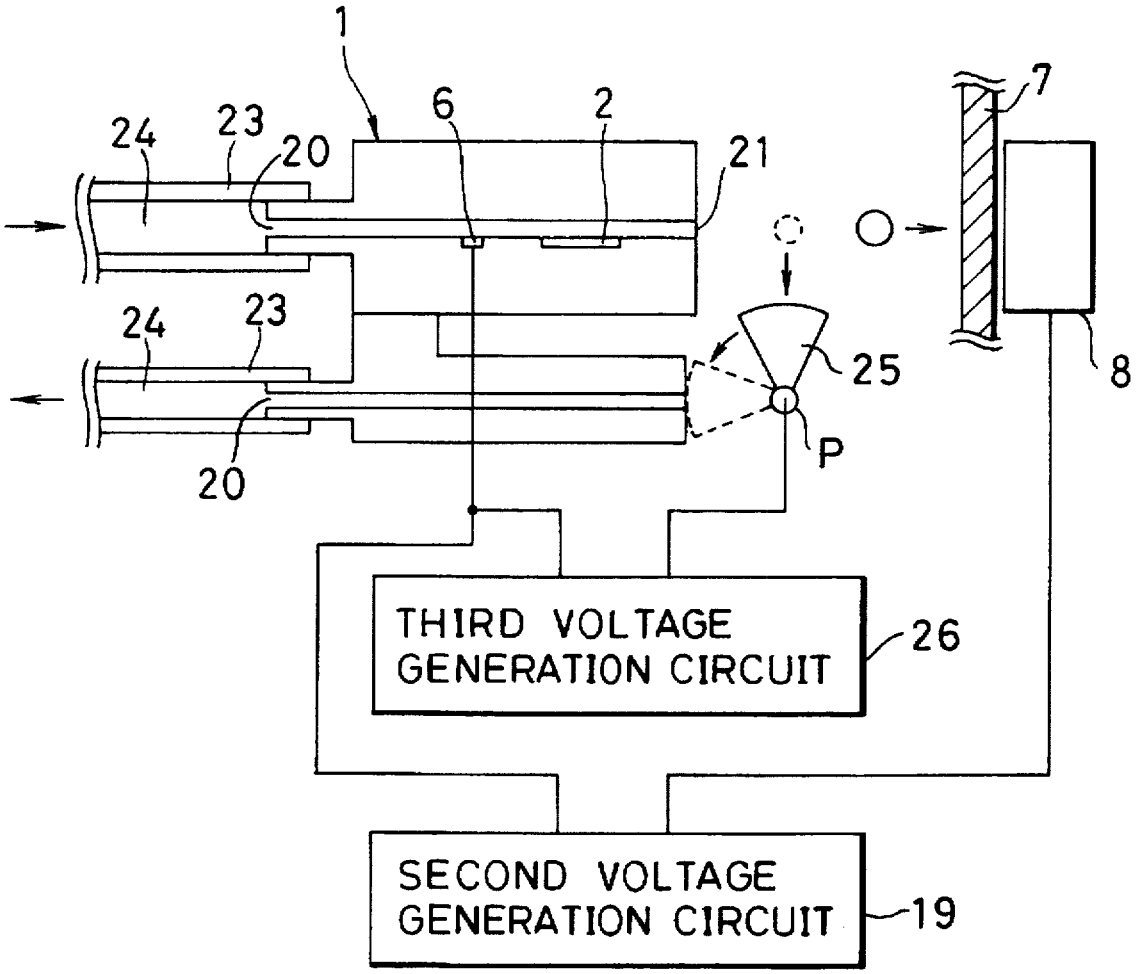
FIG. 17 is a diagrammatical view showing a tenth embodiment of the ink jet recording apparatus of the present invention.

In FIG. 17, the third electrode 25 is movable. The voltage+Va given by the third voltage generation circuit is constant. The third electrode 25 is fan-shaped and rotates in the direction designated by the arrow around the rotating shaft P. This rotational movement is synchronized with the ejection of ink drops.

The backward part of the ink drop ejected from the orifice 21 is projected onto the surface of the third electrode. The ink fluids projected onto the surface of the third electrode are collected in the ink recovery route 20.

The Eleventh Embodiment

In case that the recording head moves side by side in relation to the recording medium, it will be appreciated that a good effect can be brought by forming electrodes for collecting ink mist at both end parts of the orifice between which the recording head moves side by side.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use such basic principles to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to generate thermal energy corresponding to recording information; second, the thermal energy induces a sudden temperature rise that exceeds the nucleate boiling so as to cause film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consist of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system, are a capping means and a cleaning means for the recording head, and a pressure or suction means for the recording head. Examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus also can be changed For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, according to the present invention, in controlling the timing of separating the main drop as the forward part of the ejected ink drop and the satellite drop as the backward part of the ejected ink drop by developing the electric field between the ink fluids in the orifice and the recording medium in ejecting ink drops, (1) by reducing the intensity of the electric field, the main drop can be accelerated, and the satellite drop can be prevented from moving backward to the orifice; and (2) by reversing the gradient of the electric field, the main drop can be accelerated, and the satellite drop can be also accelerated.

As a result, in comparison with the prior art apparatus, it will be appreciated that the correctness of positioning ejected ink drops onto the recording medium can be increased and that the recording quality of recorded characters and images can be increased.

As the satellite drops never go back to the orifice, it will be appreciated that the recording operation can be continued for a long period of time with high reliability.

According to the present invention, in the recording method where a single ink drop is ejected in a single ejection operation and the ink drop is separated into a plurality of parts during the ink drop being ejected or traveling, by defining the recording method so as to use the mechanism for collecting the backward part of a plurality of separated parts of the ink drop, it can be prevented that the recording quality is reduced by fine-sized ink drops being projected on unexpected positions on the surface of the recording medium.

Owing to preventing the phenomena where fine-sized ink drops are projected on the top face of the orifice of the recording head and the designated operation for ejecting ink drops is restricted, it will be appreciated that good-conditioned recording operations can be continued. So far, the recording quality can be increased.

Though, in the prior art apparatus, a wiping operation for cleaning the surface of the orifice of the recording head should be scheduled regularly, it will be appreciated in the present invention that, the recording operation can be continuously maintained for a longer period of time and that the wiping operation can be eliminated, and thus, the overall period of time spent for recording operations can be reduced.

Even in case that the ejected ink drop is separated in 3 or more parts other than the main drop in the forward part and the satellite drop in the backward part in separating the traveling ink drop, the effect brought by the present invention with respect to collecting the satellite drop can be expected.

The individual polarities of the voltages applied to the second and third electrodes in relative to the first electrode can be made to be different from each other so as to obtain the same effect as that described above.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus using an ink jet recording head having an orifice from which an ink fluid is ejected as an ink drop, said ejected ink drop being charged to separate into a main droplet and a small droplet, due to polarization of the ink drop, after having been ejected from the orifice in a space defined between the orifice and a facing surface, said small droplet having a polarity which is opposite to a polarity of said main droplet, the apparatus comprising:

a first electrode for providing an electrical charge to said ink drop ejected from the orifice;

a second electrode spaced from the first electrode for attracting the main droplet to said facing surface; and a voltage control means for generating a first electric field in the space between said first electrode and said second electrode, said first electric field attracting the charged ink drop to the facing surface, and followed by generating a second electric field attracting the small droplet to the facing surface, said second electric field being generated in accordance with the separation of the charged ink drop into the main droplet and the small droplet, during a period of time between the ejection of the charged ink drop and arrival of the main droplet of the charged ink droplet at the facing surface.

2. An ink jet recording apparatus as claimed in claim 1, wherein an intensity of an electric field developed by said first voltage is 800 V/mm or more.

3. An ink jet recording apparatus as claimed in claim 1, wherein said energy generation means includes an electrothermal conversion device.

4. An ink jet recording apparatus as claimed in claim 1, wherein said energy generation means includes an electromechanical conversion device.

5. An ink jet recording apparatus as claimed in claim 1, wherein said ink jet recording head accommodates the ink fluid which is ejected as said ink drop from said orifice.

6. An ink jet recording apparatus as claimed in claim 1, wherein said ink jet recording head comprises an energy generation means for generating energy sufficient to eject the ink fluid from the orifice.

7. An ink jet recording apparatus as claimed in claim 1, wherein said first electrode is disposed in the orifice in electrical contact with the ink fluid.

8. An ink jet recording apparatus as claimed in claim 7, wherein said second electrode is disposed at a position which is opposite to the orifice and which is separated from the orifice by a designated distance.

9. An ink jet recording apparatus using an ink jet recording head having an orifice from which an ink fluid is ejected as an ink drop which travels towards a facing surface, said ejected ink drop being charged to separate into a main droplet and a small droplet, said small droplet having a polarity which is opposite to a polarity of said main droplet the apparatus comprising:

a first electrode for providing an electrical charge to said ink drop ejected from the orifice;

a second electrode spaced from the first electrode for attracting the main droplet to said facing surface;

a third electrode disposed at a position which is separated from a surface having a plurality of said orifice and which is outside of a zone, said zone being defined by traveling of said main droplet and said small droplet, said third electrode having a polarity which is opposite to the polarity of said small droplet to prevent said small droplet from traveling toward said surface for said plurality of orifice.

10. An ink jet recording apparatus as claimed in claim 9, wherein an effective intensity of the electric field generated between and by said first electrode and said second electrode is 800 V/mm or more.

11. An ink jet recording apparatus as claimed in claim 9, wherein a polarity of a voltage applied from said first electrode to said second electrode is opposite to a polarity of a voltage applied from said first electrode to said third electrode.

12. An ink jet recording apparatus as claimed in claim 9, wherein said third electrode is comprised of a porous and electrically conductive material so as to collect efficiently said small droplet of the ejected ink drop.

13. An ink jet recording apparatus as claimed in claim 9, wherein said energy generation means includes an electrothermal conversion device.

14. An ink jet recording apparatus as claimed in claim 9, wherein said energy generation means is includes an electromechanical conversion device.

15. An ink jet recording apparatus as claimed in claim 9, wherein said ink jet recording head accommodates the ink fluid which is ejected as said ink drop from said orifice.

16. An ink jet recording apparatus as claimed in claim 9, wherein said ink jet recording head comprises an energy generation means for generating energy sufficient to eject the ink fluid from the orifice.

17. An ink jet recording apparatus as claimed in claim 9, wherein said first electrode is disposed in the orifice in electrical contact with the ink fluid.

18. An ink jet recording apparatus as claimed in claim 9, wherein said second electrode is disposed at a position which is opposite to the orifice and which is separated from the orifice by a designated distance.

19. An ink jet recording apparatus as claimed in claim 9, wherein said third electrode is disposed at a position which is adjacent to a traveling path of the ink drop defined between the orifice and the facing surface.

20. An ink jet recording apparatus as claimed in claim 19, wherein a voltage applied between said first electrode and said second electrode is constant so as to generate the electric field which is oscillated.

21. An ink jet recording apparatus for recording an image on a facing surface by ejecting an ink fluid as an ink drop from an orifice, said ejected ink drop being charged to separate into a main droplet and a small droplet, due to polarization of the ink drop, after having been ejected from the orifice in a space defined between the orifice and the facing surface, the apparatus comprising:

a first electrode and a second electrode being arranged in a direction that said ejected ink drop travels, said first electrode and said second electrode enabling development of an electric field between said orifice and the facing surface, said second electrode being disposed closer to the facing surface than said first electrode, said first electrode being disposed closer to said orifice in the traveling direction of said ejected ink drop; and a voltage control means for applying a voltage to said first electrode and said second electrode, said voltage producing an electric field between said first electrode and said second electrode so that said main droplet and said small droplet are traveling toward the facing surface during a time period, said time period running from a time when said ejected ink drop is ejected to a time when said ejected ink drop separates into said main droplet and said small droplet, and, after the separation of said ejected ink drop into said main droplet and said small droplet, said voltage control means controls the voltage between said first electrode and said second electrode to reach zero so as to prevent said small droplet from traveling toward said orifice.

22. An ink jet recording apparatus as claimed in claim 21, further comprising an ink jet recording head having an energy generation means for generating energy sufficient to eject the ink fluid as said ink drop from said orifice.

23. An ink jet recording apparatus as claimed in claim 22, wherein said energy generation means comprises an electrothermal conversion device.

24. An ink jet recording apparatus as claimed. in claim 22, wherein said energy generation means comprises an electromechanical conversion device.

25. An ink jet recording apparatus as claimed in claim 22, wherein an effective intensity of the electric field generated between and by said first electrode and said second electrode is at least 800 V/mm.

26. An ink jet recording apparatus for recording an image on facing surface by ejecting an ink fluid as an ink drop from an orifice, said ejected ink drop being charged to separate into a main droplet and a small droplet, due to polarization of the ink drop, after having been ejected from the orifice in a space defined between the orifice and the facing surface, the apparatus comprising:

a first electrode and a second electrode being arranged in a direction that said ejected ink drop travels, said first electrode and said second electrode enabling development of an electric field between said orifice and the facing surface, said second electrode being disposed closer to the facing surface than said first electrode, said first electrode being disposed closer to said orifice in the traveling direction of said ejected ink drop; and a voltage control means for applying a voltage to said first electrode and said second electrode, said voltage producing an electric field between said first electrode and said second electrode so that said main droplet and said small droplet are traveling toward the facing surface during a time period, said time period running from a time when said ejected ink drop is ejected to a time when said ejected ink drop separates into said main droplet and said small droplet, and, after the separation of said ejected ink drop into said main droplet and said small droplet, said voltage control means reduces the voltage between said first electrode and said second electrode to weaken the electric field and thereby prevent said small droplet from traveling toward the surface of said orifice.

27. An ink jet recording apparatus as claimed in claim 26, further comprising an ink jet recording head having an energy generation means for generating energy sufficient to eject the ink fluid as said ink drop from said orifice.

28. An ink jet recording apparatus as claimed in claim 27, wherein said energy generation means comprises an electrothermal conversion device.

29. An ink jet recording apparatus as claimed in claim 27, wherein said energy generation means comprises an electromechanical conversion device.

30. An ink jet recording apparatus as claimed in claim 27, wherein an effective intensity of the electric field generated between and by said first electrode and said second electrode is at least 800 V/mm.

31. An ink jet recording apparatus for recording an image on a facing surface by ejecting an ink fluid as an ink drop from an orifice, said ejected ink drop being charged to separate into a main droplet and a small droplet, due to polarization of the ink drop, after having been ejected from the orifice in a space defined between the orifice and the facing surface, the apparatus comprising:

a first electrode and a second electrode being arranged in a direction that said ejected ink drop travels, said first electrode and said second electrode for developing an electric field between said orifice and the facing surface, said second electrode being closer to the facing surface than said first electrode, said first electrode being closer to said orifice in the traveling direction of said ejected ink drop; and a voltage control means for applying a voltage to said first electrode and said second electrode, said voltage for developing an electric field between said first electrode and said second electrode so that said main droplet and said small droplet are traveling toward the facing surface during a time period, said time period being from a time when said ejected ink drop is ejected to a time when said ejected ink drop separates into said main droplet and said small droplet, and, after the separation of said ejected ink drop into said main droplet and said small droplet, said voltage control means applying a voltage between said first electrode and said second electrode, said voltage having an opposite polarity to the polarity of the small droplet and thereby preventing said small droplet from traveling toward the surface of said orifice.

32. An ink jet recording apparatus as claimed in claim 31, further comprising an ink jet recording head having an energy generation means for generating energy sufficient to eject the ink fluid as said ink drop from said orifice.

33. An ink let recording apparatus as claimed in claim 32, wherein said energy generation means comprises an electrothermal conversion device.

34. An ink jet recording apparatus as claimed in claim 32, wherein said energy generation means comprises an electromechanical conversion device.

35. An ink jet recording apparatus as claimed in claim 32, wherein an effective intensity of the electric field generated between and by said first electrode and said second electrode is at least 800 V/mm.

* * * * *

UNITED STATES PATENT AND TRADEMARK OFFICE

CERTIFICATE OF CORRECTION

PATENT NO. : 5,646,659

DATED : July 8, 1997

INVENTOR(S) : JIRO MORIYAMA ET AL.

It is certified that error appears in the above-identified patent and that said Letters Patent is hereby corrected as shown below:

Title page, item

[57] ABSTRACT

Line 1, "of" should read --according to--.
Line 10, "in 2" should read --into 2--.

COLUMN 1

Line 26, "responsive" should read --response--.

COLUMN 2

Line 11, "ejected" should read --be ejected--.
Line 34, "electrode 6" should read --electrodes 6--.

COLUMN 3

Line 13, "above mentioned" should read --above-mentioned--.
Line 21, "return" should read --returning--.

COLUMN 4

Line 53, "electrode,wherein" should read --electrode, wherein--.

COLUMN 5

Line 8, "invention;" should read --invention,--.
Line 19, "invention;" should read --invention,--.
Line 30, "invention;" should read --invention,--.

UNITED STATES PATENT AND TRADEMARK OFFICE

CERTIFICATE OF CORRECTION

PATENT NO. : 5,646,659

DATED : July 8, 1997

INVENTOR(S) : JIRO MORIYAMA ET AL.

It is certified that error appears in the above-identified patent and that said Letters Patent is hereby corrected as shown below:

COLUMN 6

Line 67, "liquid." should read --liquid--.

COLUMN 7

Line 50, "electric." should read --electric--.

COLUMN 8

Line 3, "control." should read --control--.
Line 4, "this;" should read --this--.
Line 13, "fan-shaped The" should read fan-shaped. The--.
Line 53, "not shown" should read --(not shown)--.

COLUMN 9

Line 16, "travels," should read --travel,--.
Line 27, "relative" should read --relation--.
Line 43, "relative" should read --relation--.

COLUMN 10

Line 16, "principle" should read --principles--.

UNITED STATES PATENT AND TRADEMARK OFFICE

CERTIFICATE OF CORRECTION

PATENT NO. : 5,646,659

DATED : July 8, 1997

INVENTOR(S) : JIRO MORIYAMA ET AL.

It is certified that error appears in the above-identified patent and that said Letters Patent is hereby corrected as shown below:

COLUMN 11

Line 11, "system," should read --system--.
Line 14, "system," should read --system--.
Line 21, "changed For" should read --changed. For--.

COLUMN 12

Line 36, "that," should read --that--.
Line 47, "relative" should read --relation--.

COLUMN 13

Line 17, "an electric" should read --the electric-- and "developed by said" should read --generated--.
Line 18, "first voltage" should be deleted.
Line 19, "claim 1," should read --claim 6,--.
Line 22, "claim 1," should read --claim 6,--.
Line 35, "claim 7," should read --claim 1,--.
Line 41, "drop which travels toward a facing surface," should read --drop,--.
Line 43, "droplet and" should read --droplet which travels toward a facing surface and--.
Line 44, "droplet" should read --droplet,--.

UNITED STATES PATENT AND TRADEMARK OFFICE

CERTIFICATE OF CORRECTION

PATENT NO. : 5,646,659

DATED : July 8, 1997

INVENTOR(S) : JIRO MORIYAMA ET AL.

It is certified that error appears in the above-identified patent and that said Letters Patent is hereby corrected as shown below:

COLUMN 14

Line 4, "claim 9," should read --claim 16,--.
Line 7, "claim 9," should read --claim 16,--.
Line 8, "is" should be deleted.

COLUMN 15

Line 1, "claimed." should read --claimed--.
Line 9, "facing" should read --a facing--.

Signed and Sealed this

Tenth Day of March, 1998

*Attest:*

*Attesting Officer*

BRUCE LEHMAN

*Commissioner of Patents and Trademarks*